US005590615A

United States Patent [19]

Wong

[11] Patent Number: 5,590,615

[45] Date of Patent: Jan. 7, 1997

[54] PUCKER FREE GARMENT SEAM AND METHOD OF MANUFACTURE

[75] Inventor: John Wong, Cote St. Luc, Canada

[73] Assignee: TAL Apparel Ltd., Hong Kong, Hong Kong

[21] Appl. No.: 613,656

[22] Filed: Mar. 11, 1996

Related U.S. Application Data

[63] Continuation of Ser. No. 245,122, May 17, 1994.

[51] Int. Cl.[6] ..... D05B 1/18; A41O 27/10; B32B 7/08; B32B 7/12

[52] U.S. Cl. ..... 112/441; 112/475.09; 2/125; 2/275; 156/93

[58] Field of Search ..... 112/403, 417, 112/418, 402, 441, 440, 475.09; 2/125, 275, 243 R, 272, DIG. 5; 156/91, 92, 93, 275.5; 428/102, 375, 418, 172, 186, 354; 223/2, 4

[56] References Cited

U.S. PATENT DOCUMENTS

| | | | |
|---|---|---|---|
| 1,706,461 | 3/1929 | Oathout | 2/275 X |
| 1,784,942 | 12/1930 | Miller | 112/418 |
| 2,120,458 | 6/1938 | Bodle | 156/3 X |
| 2,264,224 | 11/1941 | Swan | 156/93 X |
| 2,266,953 | 12/1941 | Blue | 156/93 X |
| 2,719,803 | 10/1955 | Nottebohm | 428/102 |
| 2,731,788 | 1/1956 | Donaldson, Jr. | 57/238 |
| 2,925,642 | 2/1960 | Pfeffer, Jr. | 428/375 |
| 2,937,380 | 5/1960 | Reese | 112/440 |
| 2,988,457 | 6/1961 | Gatcomb | 2/275 X |
| 3,094,705 | 6/1963 | Reid et al. | 28/153 |
| 3,399,642 | 9/1968 | Etchison et al. | 112/475.01 |
| 3,453,662 | 7/1969 | Weiss | 112/475.01 |
| 4,077,066 | 3/1978 | Weiss | 2/129 |
| 4,549,916 | 10/1985 | Off et al. | 156/93 |
| 4,803,109 | 2/1989 | Saniscalchi | 156/93 X |
| 5,003,902 | 4/1991 | Benstock et al. | 112/440 X |
| 5,063,101 | 11/1991 | Grynaeus et al. | 428/172 |

FOREIGN PATENT DOCUMENTS 1104802 12/1958 Germany .

*Primary Examiner*—Ismael Izaguirre
*Attorney, Agent, or Firm*—Bradford E. Kile

[57] ABSTRACT

A pucker free garment seam providing a garment with a tailored and wrinkle free appearance. The pucker free seam and method of manufacture utilizes a bonding element which contains at least a thermal adhesive component which is inserted between first and second garment components along the seam. A sufficient amount of heat and pressure is applied to the seam which causes the adhesive of the bonding element to flow onto the surfaces of the garment components thereby creating a compressed seam and permanently bonding the first and second garment components together along the seam to eliminate puckering associated with shrinkage of the sewing thread.

29 Claims, 3 Drawing Sheets

FIG. 1
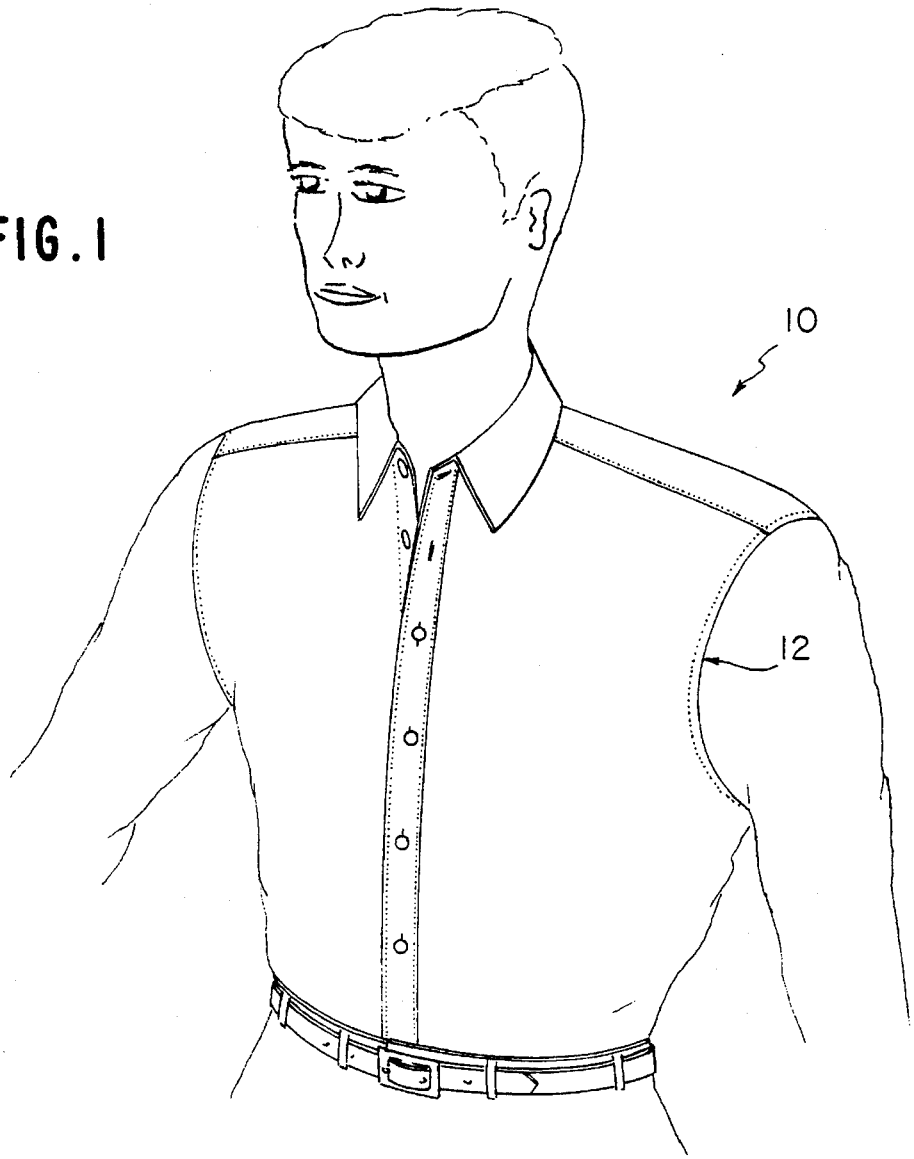
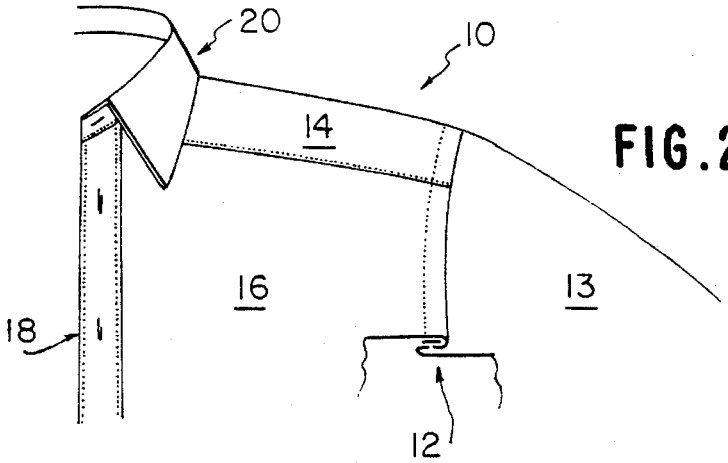
FIG. 2

PUCKER FREE GARMENT SEAM AND METHOD OF MANUFACTURE

This application is a continuation of application No. 08/245,122, filed May 17, 1994.

BACKGROUND OF THE INVENTION

The present invention relates to a pucker free garment seam and method of manufacture. More specifically, the invention is directed to an improved garment seam and method of manufacture which faciley eliminates a tendency of the seam to bunch or pucker around a sleeve attachment area and other similar areas following conventional laundering procedures.

A puckering phenomenon at seam lines has long plagued the garment industry. Seam pucker is typically caused by thread shrinkage which occurs during laundering of a garment. In particular, after a garment is purchased by a garment consumer it is subjected to laundering cycles as the shirt is worn and becomes soiled. During these laundering and drying cycles the sewing thread typically undergoes longitudinal shrinkage. It is this shrinkage at a rate greater than the surrounding shirt material that creates puckering at a seam joining two panels of fabric. In this, the sewing thread contracts upon being laundered and pulls on opposing garment components at the garment seam which in turn causes the garment components to buckle and thereby creating wrinkles along the garment seam. This effect is most noticeable in dress shirt shoulder seams. Accordingly, it would be highly desirable to provide a method of manufacture and garment which would be free of this pucker phenomenon and which would maintain a seam which is smooth and pucker free even after multiple laundering operations.

Several attempts have been made to reduce seam pucker. One such attempt utilizes an interlining having a thermoplastic component in the interlining matrix. During the manufacture process the seam is ironed which reduces the cross-sectional thickness of the seam along the stitch line. The reduced thickness allows for slack in the sewing thread such that during subsequent laundering the sewing thread is permitted to shrink an amount equal to the slack. This attempt is not entirely effective in reducing seam pucker. First, the garment components sewn together at the seam are allowed to pull apart between outer stitches of the seam which results in buckling of the garment fabric. Second, the thread which is compressed in the interlining matrix becomes bound within the matrix thus shrinkage of the thread still results in at least a degree of seam pucker. Third, the manufacturing of an interlining results in overall increase in garment manufacturing cost. This cost is compounded if the interlining is a composite interlining.

Another prior art attempt at reducing seam pucker utilizes specified garment material. Specifically, the garment components sewn together at the seam are manufactured from material which stretches during the sewing process and which relaxes after the sewing process is complete. This relaxation provides for slack in the sewing thread. This attempt is also ineffective at reducing seam pucker. First, as before, the garment components sewn together at the seam are allowed to pull apart between outer stitches of the seam which results in buckling of the garment fabric. Second, only garments manufactured from certain stretch materials may be utilized to manufacture the garments. The disadvantages associated with this are clear.

Still other prior art attempts alter the nature of the sewing thread used in the sewing process. For example, one such attempt utilizes a composite sewing thread whereby one component of the thread is water soluble. During the laundering process the water soluble component dissolves thereby creating slack in the sewing thread which compensates for thread shrinkage. First, as before, the garment components sewn together at the seam are allowed to pull apart between outer stitches of the seam which results in buckling of the garment fabric. Second, the high cost of manufacturing a sewing thread altered in this way greatly increases the overall garment cost. Third, thread strength is greatly reduced by such a composite design. Last, commercial sewing apparatus are not well adapted to utilize altered thread. The other prior art attempts which alter the nature of the sewing thread are ineffective for the same noted reasons.

The difficulties and limitations suggested in the preceding are not intended to be exhaustive, but rather are among many which demonstrate that although significant attention has been devoted to reducing pucker in garment seams, the puckerless garment seams and method of manufacture appearing in the past will admit to worthwhile improvement.

OBJECTS AND BRIEF SUMMARY OF THE INVENTION

It is therefore a general object of the invention to provide a novel, smooth garment seam and method of manufacture which will obviate or minimize difficulties of the type previously described.

It is a specific object of the invention to provide a smooth garment seam and method of manufacture which will eliminate seam pucker.

It is another object of the invention to provide a smooth garment seam and method of manufacture which may be used in a variety of garments to provide a pucker free tailored appearance.

It is still another object of the invention to provide a smooth garment seam and method of manufacture for advantageous use in an armhole seam of a dress shirt.

It is yet another object of the invention to provide a smooth garment seam and method of manufacture which provides for a cost effective solution to seam pucker and does not involve significant modification of existing manufacturing apparatus.

BRIEF SUMMARY OF A PREFERRED EMBODIMENT OF THE INVENTION

A preferred embodiment of the invention which is intended to accomplish the foregoing objects includes a bonding element which contains at least a thermal adhesive component which is inserted between first and second garment components along a seam line of a garment. The seam is subjected to a sufficient amount of heat and pressure to cause the adhesive of the bonding element to flow over the surfaces of the garment components thereby creating a compressed seam and permanently bonding the first and second garment components together along the seam to eliminate puckering associated with sewing thread shrinkage.

DRAWINGS

Other objects and advantages of the present invention will become apparent from the following detailed description of a preferred embodiment thereof taken in conjunction with the accompanying drawings, wherein:

FIG. 1 is a pictorial view showing a human male figure wearing a shirt having a seam manufactured in accordance with the present invention;

FIG. 2 is a schematic detail view showing an armhole seam of the dress shirt depicted in FIG. 1 which armhole seam has been manufactured in accordance with the present invention;

Figure 3A:
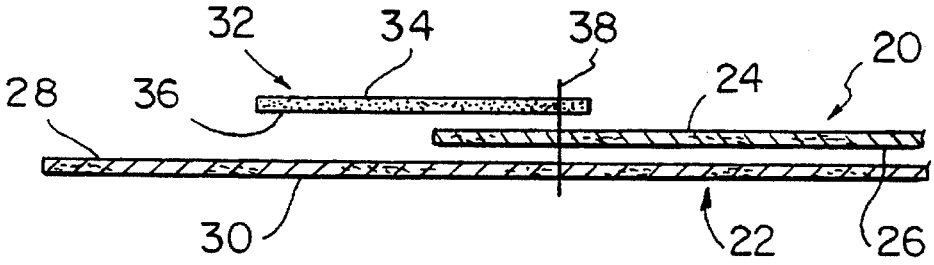
Figure 3B:
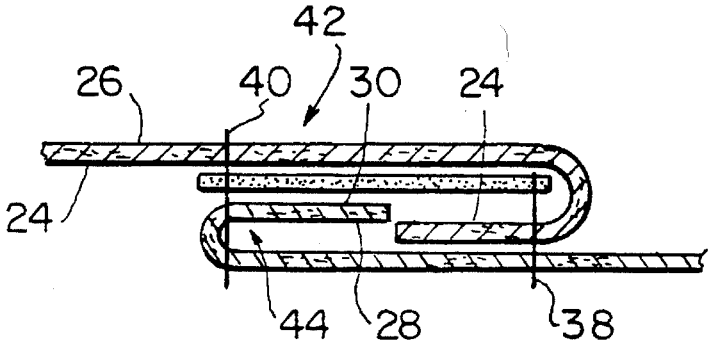
Figure 3C:
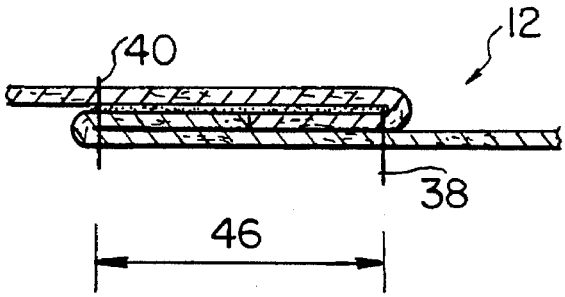
Figure 4A:
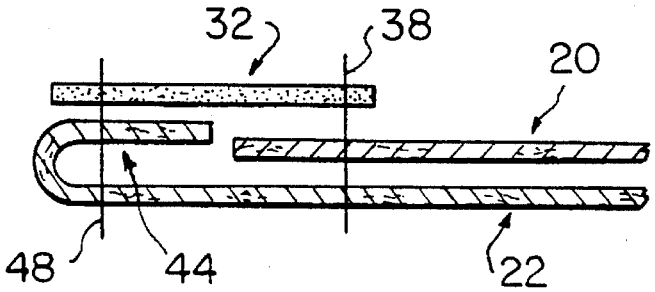
Figure 4B:
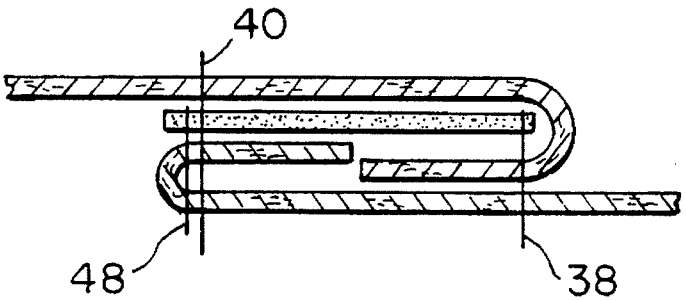
Figure 4C:
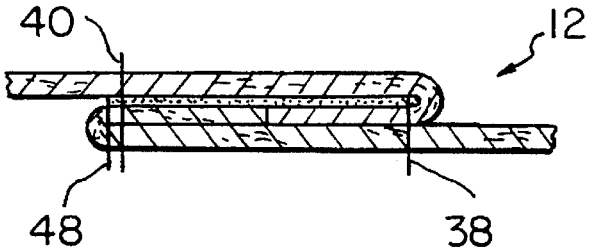

FIGS. 3*a* through 3*c* shows a cross-sectional view of a method of manufacturing a dress shirt armhole seam in accordance with the present invention utilizing a single needle set sleeve;

FIGS. 4*a* through 4*c* shows a cross-sectional view of a method of manufacturing a dress shirt armhole seam in accordance with the present invention utilizing a double needle set sleeve.

DETAILED DESCRIPTION

Referring now to the drawings and particularly to FIG. 1, there is shown a human male wearing a dress shirt 10 having an armhole seam 12 manufactured in accordance with the present invention. FIG. 2 shows the dress shirt 10 having an armhole seam 12, shirt yoke 14, front panel 16, rear panel (not shown), center placket 18, collar 20, and sleeve 13. Although the specific embodiment as shown in the figures is directed to an armhole seam of a dress shirt, it is to be understood that the seam and method of manufacture of the present invention can advantageously be utilized in for a variety of seams in a variety of garments. For example, a center placket seam, collar seam, or cuff seam of a dress shirt or various seams of dress slacks. The phenomenon of seam pucker is most troubling in armhole seams because of their visible location and the manner of attachment between the shirt body (usually consisting of a front panel, yoke, and rear panel) and the shirt sleeve.

FIGS. 3*a* through 3*c* show the progressive manufacturing steps for manufacturing the seam of the present invention. FIG. 3*c* shows a cross-sectional view of a completed armhole seam 12 manufactured in accordance with the present invention. The embodiment of FIGS. 3*a* through 3*c* utilizes a single needle set sleeve. Referring to FIG. 3*a* there is shown a first garment component 20 and a second garment component 22. In the armhole embodiment of the present invention, the first garment component comprises a front panel 16, shirt yoke 14, and a rear panel (not shown) and the second garment component comprises a shirt sleeve 13. The first garment component has an upper surface 24 and a lower surface 26. The second garment component has an upper surface 28 and a lower surface 30.

A bonding element 32 forms an integral part of the present invention. The bonding element 32 has an upper surface 34 and a lower surface 36. In the preferred embodiment of the invention and as shown in the figures, the bonding element is an adhesive web consisting entirely of an adhesive material. The adhesive material is preferably composed of a polyamide, polyester, or an olefinic material such as a low density polyethylene. Other thermoplastic materials such as polyurethane and ethylene vinylacetate copolymer can also be used. The aforementioned adhesive are preferable because they all have a low melting point in the range of 60–160 degree celsius. In the preferred embodiment, the adhesive web is manufactured from a plurality of filaments having a diameter ranging between 20–80 microns. Furthermore, the adhesive web of the present invention has a density of approximately 10–100 grams per square meter. Alternatively, a more solid structured net adhesive may be used having a density preferably in a range of 8–80 grams per square meter. Of course, other types of adhesives are contemplated in the present invention.

After the bonding element 32, first garment component 20, and second garment component 22 are positioned as shown in FIG. 3*a*, a first stitch 38 is sewn along the seam line defined by the first and second garment components. In the embodiments of FIGS. 3*a* through 3*c* this stitch is a needle set sleeve stitch and is the only set sleeve stitch. As depicted in FIG. 3*b*, after the stitch 38 is made through the bonding element 32 and first and second garment components, the first garment 20 component is folded over the bonding element 34 such that the upper surface 24 of the first garment component 20 abuts the upper surface 34 of the bonding element 32. Similarly, the second garment component is folded such that the lower surface 30 of the second garment component 22 abuts the lower surface 36 of the bonding element 32. Next, a second stitch 40 is sewn to attach the folded portion 42 of the first garment component 20, the bonding element 32, the folded portion 44 of the second garment component 22, and the second garment component 22 as shown in FIG. 3*b*.

The manufacture of the improved seam of the present is completed with the application of heat and pressure to the seam. This can be accomplished with a conventional ironing process. For improved control and quality this process is usually carried out on a heated press with a temperature of up to 160 degrees celsius for 5 to 10 seconds followed with a vacuum step to cool and set the adhesive. The applied heat and pressure causes adhesive of the bonding element to melt and flow onto the surfaces of the first and second components. That is, the adhesive flows onto surface 24 of the folded portion 42 of the first garment component, surface 24 of the first garment component which abuts the lower surface 26 of the bonding element, and surface 30 of the folded portion 44 of the second garment component 22. Significantly, during the ironing/pressing process, the flowing adhesive becomes interposed in the garment fabric of the first and second component. This is advantageous because it creates a very strong bond between the surfaces of the garment components along the seam. It is this bond that prevents seam pucker during subsequent laundering. In particular, because the first and second components are bonded together along the seam, they can not pull apart during laundering and, therefore, buckling of the seam fabric located between the stitches 38 and 40 will be prevented. This is a significant advantage over the prior art seams which permit the fabric comprising the first and second garment components to become separated during subsequent laundering which in turn results in seam pucker. The ironing/pressing process also compresses seam to reduce the seam thickness.

The distance 46 between stitches 38 and 40 as shown in FIG. 3*c* defines the seam width. The folded portion 42 of the first garment component 20 is the visible portion of the armhole seam 12. As such, for maximum prevention of pucker, it is important to have the adhesive of the bonding element 32 flow over the entire surface 24 of the seam width 46. This will ensure complete bonding of the folded back portion 42 of the first garment component 20 to the surface 24 of the first garment component which abuts the lower surface 26 of the bonding element, and surface 30 of the folded portion 44 of the second garment component 22.

Although in the preferred embodiment the bonding element 32 consist of an adhesive web as described above, other elements are contemplated. In an alternative embodiment the bonding element 32 consist of an interlining having an adhesive coating on its outer surfaces. Interlinings are known in the art to provide stiffness to garment components. For example, interlinings are used in shirt collars and center plackets to provide a degree of stiffness. However, the interlinings of the present invention utilizes an adhesive on its outer surfaces and is specifically used for garment seams. More specifically, the interlining body of the present invention is preferably a woven interlining made from cotton or a polyester/cotton blend. Alternatively, a nonwoven interlining body made from polyester, nylon, viscose or blends of these materials may be used. Preferably, the interlining body is fabricated from a single material so as to avoid the high cost associated with manufacturing composite interlinings. The interlinings have a coating of an adhesive on an upper and lower surface. The adhesive is preferably one of the same thermal adhesives previously mentioned in the adhesive web embodiment discussed above. The adhesive may be applied on the upper and lower surfaces of the interlining as an adhesive layer or as a series of adhesive dots. Significantly, a quantity of adhesive sufficient to flow over the garment surfaces as described above is needed in order to provide complete bonding as contemplated by the present invention. Although this interlining embodiment is adequate to achieve the results of the present invention, it is not preferable because of the increased manufacturing cost associated with providing a separate interlining.

FIGS. 4*a* through 4*c* show an alternative manufacturing process in accordance with the present invention which utilize the same reference numerals to depict similar seam components. The resulting armhole seam 12 utilizes a double needle set sleeve and is depicted in FIG. 4*c*. This embodiment employs the identical manufacturing steps of FIGS. 4*a* through 4*c* with the exception of an additional seam stitch. In particular, stitch seam 48 is sewn to attach the bonding element 32, the folded portion 44 of the second garment component 22, and the garment component 22. The stitch 48 is an additional needle set sleeve and therefore provides for a double needle set sleeve. Although the additional stitch 48 is not necessary in order to achieve the advantageous results of the present invention, it is helpful in ensuring that the bonding element is properly aligned in the seam.

The pucker free garment seam 12 depicted in the figures is only an exemplary seam and is not intended to limit the scope of the invention. For example, the first and second garment components could be folded in a different arrangement or not folded at all.

SUMMARY OF MAJOR ADVANTAGES OF THE INVENTION

After reading and understanding the foregoing detailed description of an inventive garment seam and method of manufacture in accordance with preferred embodiments of the invention, it will be appreciated that several distinct advantages of the subject garment seam and method of manufacture are obtained.

Without attempting to set forth all of the desirable features of the instant garment seam and method of manufacture, at least some of the major advantages include providing a pucker free garment seam 12 consisting of a first garment component 20, such as a component consisting of dress shirt front panel 16, yoke 14, and rear panel; a second garment component 22 such as a dress shirt sleeve 12; and a bonding element 32.

The use of the bonding element 32 provides for a pucker free garment seam which has not been successfully accomplished by prior art attempts. Preferably, the bonding element 32 comprises an adhesive web which flows during ironing onto the abutting surfaces of the garment components to create a very strong bond between the garment components along the garment seam 12. This bond prevents the first garment component 20 from separating from the second garment component 22 during subsequent laundering of the garment. Alternatively, bonding element 32 consist of an interlining body having a thermal adhesive coating on its outer surface. The interlining body can be fabricated from a single material thus avoiding the use of costly composite interlining body.

The garment seam and method of manufacture of the present invention provides for a less costly alternative to other prior art attempts at eliminating seam pucker and without the need for substantial modification of current seam manufacturing operations.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A method of manufacturing a pucker free garment seam between first and second garment components comprising the steps:

(a) providing a first garment component having an upper surface and a lower surface;

(b) providing a second garment component in a juxtaposed relationship with respect to the first garment component to be joined at a seam to the first garment component;

(c) providing a bonding element having an upper and lower surface and at least a thermal adhesive component and placing the bonding element along the seam formed by the positioning of the first garment component and the second garment component such that the lower surface of the bonding element contacts at the seam the upper surface of the first garment component;

(d) sewing a first set stitch along a side of the seam such that the first stitch traverses through the bonding element, the first garment component, and the second garment component; and (e) folding the first garment component over the bonding element such that the upper surface of the first garment component is folded over and abuts an upper surface of the bonding element along the seam, the folded over portion of the first garment component is positioned such that it covers portions of the first stitch that protrude through the bonding element along its upper surface;

(f) sewing a second stitch running along a side of the seam opposite the first stitch such that the second stitch traverses through at least the folded over portion of the first garment component and the second garment component; and (g) applying sufficient heat and pressure to the bonding element to cause the thermal adhesive to melt such that the adhesive flows onto the surfaces of at least the upper surface of the first garment component to provide a bond along the seam such that the bonded components will effectively reduce a tendency of the seam to pucker during laundering.

2. A method of manufacturing a smooth seam as defined in claim 1 wherein said bonding element is a thermal adhesive web composed entirely of a thermal adhesive.

3. A method of manufacturing a smooth seam as defined in claim 2 wherein said thermal adhesive web is composed of a plurality of adhesive filaments having a diameter ranging approximately between 20 to 80 microns.

4. A method of manufacturing a smooth seam as defined in claim 2 wherein said thermal adhesive web has a density of approximately 10 to 100 grams per square meter.

5. A method of manufacturing a smooth seam as defined in claim 1 wherein said bonding element comprises an interlining having on upper and lower surfaces a quantity of adhesive.

6. A method of manufacturing a smooth seam as defined in claim 5 wherein said interlining is a woven interlining fabricated from cotton.

7. A method of manufacturing a smooth seam as defined in claim 5 wherein said interlining is a woven interlining fabricated from polyester/cotton blend.

8. A method of manufacturing a smooth seam as defined in claim 5 wherein said interlining is a nonwoven interlining fabricated from a material selected from the group consisting of polyester, nylon, and viscose and blends thereof.

9. A method of manufacturing a smooth seam as defined in claim 1 wherein said adhesive is composed of a thermoplastic material.

10. A method of manufacturing a smooth seam as defined in claim 9 herein said adhesive is composed of a thermoplastic material selected from the group consisting of polyamide, polyester, olefinic, polyurethane, and ethylene vinylacetate copolymer materials.

11. A method of manufacturing a smooth seam as defined in claim 1 wherein said thermal adhesive has a melting point ranging from approximately 60 to 160 degrees celsius.

12. A method of manufacturing a smooth seam as defined in claim 1 wherein said bonding element is a thermal adhesive net having a density of approximately 8 to 80 grams per square meter.

13. A method of manufacturing a smooth seam as defined in claim 1 wherein said first garment component comprises a front panel, yoke, and rear panel of a dress shirt and said second garment component comprises a shirt sleeve such that said seam is the seam of a shirt armhole.

14. A method of manufacturing a smooth seam as defined in claim 1 wherein said seam is the seam of a dress shirt armhole.

15. A method of manufacturing a smooth seam as defined in claim 1 wherein the application of heat and pressure of step (e) is accomplished by an ironing and pressing process.

16. A method of manufacturing a smooth seam as defined in claim 15 wherein the ironing and pressing process is carried out at a temperature up to 160 degrees celcius for 5 to 10 seconds.

17. A method of manufacturing a pucker free garment seam as set forth in claim 1 wherein:

in step (f), the second stitch traverses through the folded over portion of the first garment component, the bonding element, and the second garment component.

18. A method of manufacturing a smooth seam as defined in claim 1 and further comprising the step of:

sewing an additional set stitch along the seam such that the additional stitch traverses through the bonding element, the folded over portion of the second garment component, and the second garment component prior to the step of sewing the first and second components and the bonding element together by a second stitch running along the seam.

19. In a clothing garment, a pucker free seam comprising: a bonding element having at least a thermal adhesive component and having an upper and lower surface;

a first garment component having an upper and lower surface, the first garment component being folded over the bonding element such that a portion of the upper surface of the first garment component is bonded to the lower surface of the bonding element and another portion of the upper surface of the first garment component is bonded to the upper surface of the bonding element;

a second garment component having an upper and lower surface positioned such that a portion of the upper surface of the second garment component abuts at least a portion of the lower surface of the first garment component along the seam;

a first set stitch running along a first side of the seam and traversing through the bonding element, the portion of the first garment component bonded to the lower surface of the bonding element, and the portion of the second garment component which abuts the lower surface of the first garment component;

a second stitch running along a second side of the seam and traversing at least through the folded over portion of the first garment component and the second garment component;

the bonding element of the seam being subjected to a sufficient amount of heat and pressure to cause the thermal adhesive to bond to at least the upper surface of the first garment component to provide a bond along the seam such that the bonded components will effectively reduce a tendency of the seam to pucker during laundering.

20. A smooth seam as defined in claim 19 wherein said bonding element is a thermal adhesive web composed entirely of a thermal adhesive.

21. A smooth seam as defined in claim 19 wherein said bonding element comprises an interlining having on upper and lower surfaces a quantity of thermal adhesive.

22. A smooth seam as defined in claim 21 wherein said interlining is a woven interlining fabricated from cotton.

23. A smooth seam as defined in claim 21 wherein said interlining is a woven interlining fabricated from polyester/cotton blend.

24. A smooth seam as defined in claim 21 wherein said interlining is a nonwoven interlining fabricated from a material selected from the group consisting of polyester, nylon, and viscose and blends thereof.

25. A smooth seam as defined in claim 19 wherein said adhesive is composed of a thermoplastic material.

26. A smooth seam as defined in claim 25 wherein said adhesive is composed of a thermoplastic material selected from the group consisting of polyamide, polyester, olefinic, polyurethane, and ethylene vinylacetate copolymer materials.

27. A smooth seam as defined in claim 19 wherein said adhesive has a melting point ranging from approximately 60 to 160 degrees celsius.

28. A smooth seam as defined in claim 19 wherein said first garment component comprises a front panel, yoke, and rear panel of a dress shirt and said second garment component comprises a shirt sleeve such that said seam is the seam of a shirt armhole.

29. A smooth seam as defined in claim 19 wherein said seam is the seam of a dress shirt armhole.

* * * * *